US006151851A

United States Patent [19]

Carter

[11] Patent Number: 6,151,851

[45] Date of Patent: Nov. 28, 2000

[54] STACKABLE SUPPORT COLUMN SYSTEM AND METHOD FOR MULTISTORY BUILDING CONSTRUCTION

[76] Inventor: Michael M. Carter, 9407 25th St. East, Parrish, Fla. 34219

[21] Appl. No.: 09/430,205

[22] Filed: Oct. 29, 1999

[51] Int. Cl.[7] ..... G04H 1/00

[52] U.S. Cl. ..... 52/236.3; 52/726.1; 52/736.1

[58] Field of Search ..... 52/236.3, 236.9, 52/726.1, 726.3, 731.1, 736.1, 737.1, 748.18, 747.1, 123.1, 125.1; 403/379.3, 377, 378

[56] References Cited

U.S. PATENT DOCUMENTS

| | | | |
|---|---|---|---|
| 7,412 | 6/1850 | Fisher | 52/726.1 |
| 3,017,723 | 1/1962 | Van Heidenstam | 50/140 |
| 3,254,466 | 6/1966 | Von Heidenstam | 52/745 |
| 3,260,028 | 7/1966 | Fraser | 52/745 |
| 3,355,853 | 12/1967 | Wallace | 52/745 |
| 3,713,265 | 1/1973 | Wysocki et al. | 52/745 |
| 3,793,794 | 2/1974 | Archer | 52/726.3 |
| 3,978,630 | 9/1976 | Labie et al. | 52/236 |
| 4,173,853 | 11/1979 | Logan | 52/57 |
| 4,272,929 | 6/1981 | Hanson | 52/40 |
| 4,346,540 | 8/1982 | Anderson | 52/274 |
| 5,182,884 | 2/1993 | Tarics | 52/79.14 |
| 5,320,439 | 6/1994 | Perrault | 403/379 |
| 5,687,537 | 11/1997 | Noble | 52/726.3 |

*Primary Examiner*—Carl D. Friedman
*Assistant Examiner*—Kevin McDermott
*Attorney, Agent, or Firm*—Bernstein & Associates; Jason A. Bernstein; John W. Greenwald

[57] ABSTRACT

At least one first column having a lower portion attached top a first floor and an upper portion attached to a second floor. The upper portion has a bore with an inner dimension. At least one second column having a lower portion and an upper portion attached to a third floor or building top structure. The lower portion has an outer dimension that is substantially the same or slightly less than the first column upper portion inner dimension so that the second column lower portion may be slidingly received in the bore of the first column upper portion in an overlapping, telescopic arrangement. At least one first retainer is attached to the first or second column, the retainer capable of engaging and supporting the second column thereon.

The method of construction provides for lifting without the aid of mechanical lifting devices the lightweight columns, lowering each column into the immediately below column to form an overlapping, telescopic portion which braces against bending of the columns, and retaining the columns in place with retainers that do not need to be field bolted or welded thereon.

28 Claims, 3 Drawing Sheets

STACKABLE SUPPORT COLUMN SYSTEM AND METHOD FOR MULTISTORY BUILDING CONSTRUCTION

FIELD OF THE INVENTION

The present invention relates generally to the construction of buildings with multiple stories, and more particularly, to an apparatus and method of stacking and coupling together of vertical columns for supporting the building floors.

BRIEF DESCRIPTION OF THE PRIOR ART

Multistory steel-framed buildings are typically constructed with vertical steel columns spanning the full height of the building from the bottom floor to the roof. Each column is commonly provided in one piece for buildings with only a few stories. For buildings with more than a few stories, each column is commonly provided by multiple column members each spanning several floors and connected by welding and/or bolted plates. The intermediate floors are then framed with horizontal beams attached to the columns by fin plates or welding, and joists and floor decking are installed on the horizontal beams.

One-piece steel columns spanning from the floor to the roof of a multiple story building, such as those described in U.S. Pat. No. 3,713,265 to Wysocki et al., generally provide the benefit of a very strong column. Similarly, steel column members that span multiple stories to minimize joints therebetween, such as those described in U.S. Pat. No. 3,254,466 to Heidenstam and U.S. Pat. No. 3,355,853 to Wallace, generally provide the benefit of a strong column.

In practice, each such column member is relatively long, for example, about 30 to 50 feet for a three story building. Because the steel column members are so long, they are necessarily very bulky and heavy and typically require lifting equipment to raise them up and into position. For example, a typical steel column for a typical three story building may have a weight in the range of about 700 to 1,200 pounds. For relatively heavier column members, cranes must be stationed on the construction site which adds significant cost and potential coordination difficulties to the project. Even for relatively shorter column members and/or columns fabricated of generally lighter materials, mechanical hoisting or other manual lifting is required which adds significant time and cost to the project. There is no known material for making one-piece multiple story columns that provides the desired high strength and low weight at a practical cost.

In order to reduce the weight of the columns to allow quick and easy manual hoisting of the columns, the columns may be provided in shorter lengths, however, this results in additional joints which are generally weak links in the building structure. Conventional construction techniques of welding and/or bolting plates to the column members can be employed to join together the column members. This tends to be time consuming work and introduces the possibility of poorly made and thus weak connections.

One device which attempts to remedy the problem is shown in U.S. Pat. No. 4,346,540 to Anderson, which discloses a device relating to building frameworks that comprises horizontal beams supporting floors and joined to vertical uprights which are joined together at their ends by a coupling means. The coupling means includes at the upper end of the lower upright a horizontal plate with four vertical pins extending therefrom and at the lower end of the upper upright a horizontal plate with four apertures defined therein, each aperture having a wider and a narrower portion. The upper upright is lowered onto the lower upright so that the plate apertures receive the wider portion of the pins and then the upper upright is rotated into a locked position where the pins extend through the narrower portion of the holes.

The upper upright of Anderson is thereby supported by and coupled to the lower upright in an abutting end-to-end arrangement. While this coupling may to some be an improvement over the conventional construction techniques noted above, the end-to-end arrangement and the long moment arm of the uprights create the potential for bending at the joint resulting in a less than desired strength of the building structure. Additionally, while the plates and pins could be attached to the uprights in the factory instead of on the job site for convenience and lower cost and, there remains a relatively significant time and cost associated with the attachment of the plates and pins to the uprights.

Accordingly, what is needed but not found in the prior art is an apparatus and method for constructing multistory buildings with columns that are sufficiently short and lightweight to be lifted manually without the need for cranes or mechanical hoist, yet that are capable of being coupled together so that the coupling is sufficiently strong so as not to be the weakest link in the support columns of the building structure.

SUMMARY OF THE INVENTION

Generally described, the present invention provides a stackable support column apparatus for constructing a multistory building, comprising at least one first column having a lower portion and an upper portion. The lower portion is capable of being attached to a first floor of the building and the upper portion is capable of being attached to a second floor of the building. The upper portion has a bore with an inner dimension.

At least one second column is provided having a lower portion and an upper portion. The lower portion has an outer dimension that is substantially the same or slightly less than the first column upper portion inner dimension so that the second column lower portion may be slidingly received in the bore of the first column upper portion. The upper portion is capable of being associated with a third floor or a top structure of said building. At least one first retainer is attached to the first or second column, the retainer capable of engaging and supporting the second column thereon.

In a first preferred embodiment of the present invention the first column has a height generally corresponding to a height of the first story of the building and the second column has a height generally corresponding to a height of the second story. The first column has a generally uniform cross-sectional shape and area, and the second column has a generally uniform cross-section shape that is substantially the same as the first column shape and area that is less than the first column area. The second column lower portion is thereby capable of being slidingly received into the first column upper portion in an overlapping, telescopic arrangement with an overlapping distance that is substantially the same or slightly greater than the height of the second floor.

The first retainer preferably comprises at least one upper retainer member attached to the second column at a distance from a bottom thereof, the distance being substantially the same as the overlapping distance, so that the upper retainer is capable of engaging and supporting a top end of the first column. In addition to or as an alternative to the upper retainer, at least one lower retainer is preferably provided by at least one aperture in the first column and at least one elongate member capable of extending through the aperture, so that the elongate member is capable of engaging and supporting a bottom end of the second column.

The first column may be attached directly to the first floor or may be attached to the first floor by a base column. The base column preferably has an upper portion attached to the first floor, the upper portion having a bore with an inner dimension that is substantially the same or greater than an outer dimension of a lower portion of the first column so that the base column upper portion may slidingly receive the first column lower portion.

For adding a third and higher floors, the process is repeated with additional columns with retainers similar to the first column described above. The highest column is then attached to a building top structure such as an attic floor or roof. Also, in a second preferred embodiment of the present invention, the lower retainers are provided by a plurality of apertures in a column so that the immediately above column may be secured in place in different positions as may be desired. The method for constructing a multistory building comprises the steps of providing a first floor of the building, lifting at least one first column member onto the first floor, and attaching a lower portion of the first column to the first floor directly or using a base column as described hereinabove. A second floor is then attached to an upper portion of the first column. A second column member is then lifted onto the second floor and a lower portion of the second column down is slid into a bore in the first column upper portion. The second column is braced by sliding the second column lower portion into the first column upper portion a sufficient distance so that the second column lower portion and said first column upper portion overlap in a telescopic arrangement. The second column is supported by at least one retainer associated with said second column that engages said first column. A third floor or building top structure is then attached to an upper portion of the second column. Additional floors may also be constructed by repeating the above steps.

Accordingly, it is an object of the present invention to provide an apparatus for multistory building construction with column members having lengths generally corresponding to each building story height for achieving a relatively light weight and low bulk so that they can be manually lifted into position without the aid or a crane of mechanical hoist resulting in quicker and easier erection of the building structure.

It is another object to provide a structurally strong joint between column members by providing an overlapping, telescopic portion which acts as a strengthening brace to resist and/or absorb lateral forces and prevent bending at the joint.

It is still another object to provide a coupling between the column members that is low in cost and quick and easy to install by providing upper retainers and/or lower retainers associated with the columns.

Yet another object of the present invention is to provide a method for multistory building construction whereby columns may be stacked and retained together in a high strength configuration without the aid of cranes or mechanical hoists and without welding or bolting the columns together.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
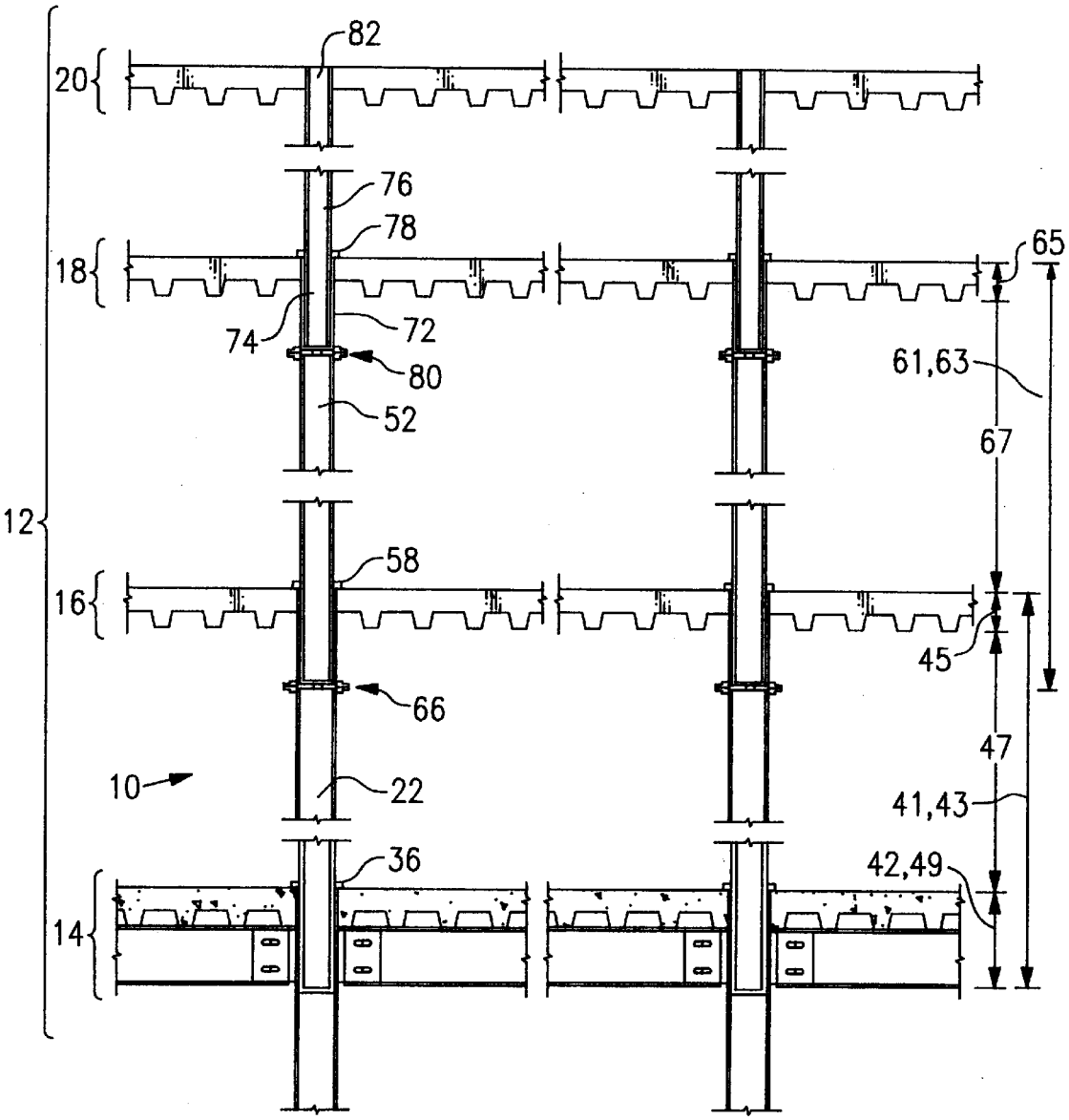
FIG. 1 is an elevation view of a multistory building constructed of a plurality of stackable support columns of a first preferred embodiment of the present invention.

Referring now to FIG. 1, there is illustrated a first preferred embodiment of the present invention, referred to generally as 10. There is provided a stackable support column apparatus 10 for constructing a multistory building 12. For purposes of illustration only, the apparatus 10 will be described with reference to the construction of a three story building 12 comprising a first floor 14, a second floor 16, a third floor 18, and at building top structure 20. The first floor 14 may be constructed in any number of ways such as by a concrete slab or by other constructions known to those skilled in the art. The second 16 and third 18 floors may be constructed in any number of ways such as by joists with metal, wood, concrete, composite, or other light weight decking laid thereon or by other constructions known to those skilled in the art. The building top structure 20 may be constructed in any number of ways such as an attic floor, a building roof, or in other constructions known to those skilled in the art. It will be understood that the apparatus 10 may be suitably employed in other building constructions having other numbers and arrangements of building floors, such as including a fourth floor and higher floors as desired in a given building design. Also, the apparatus 10 may be suitably employed in the construction of residential, commercial, industrial, or other buildings.

Figure 2:
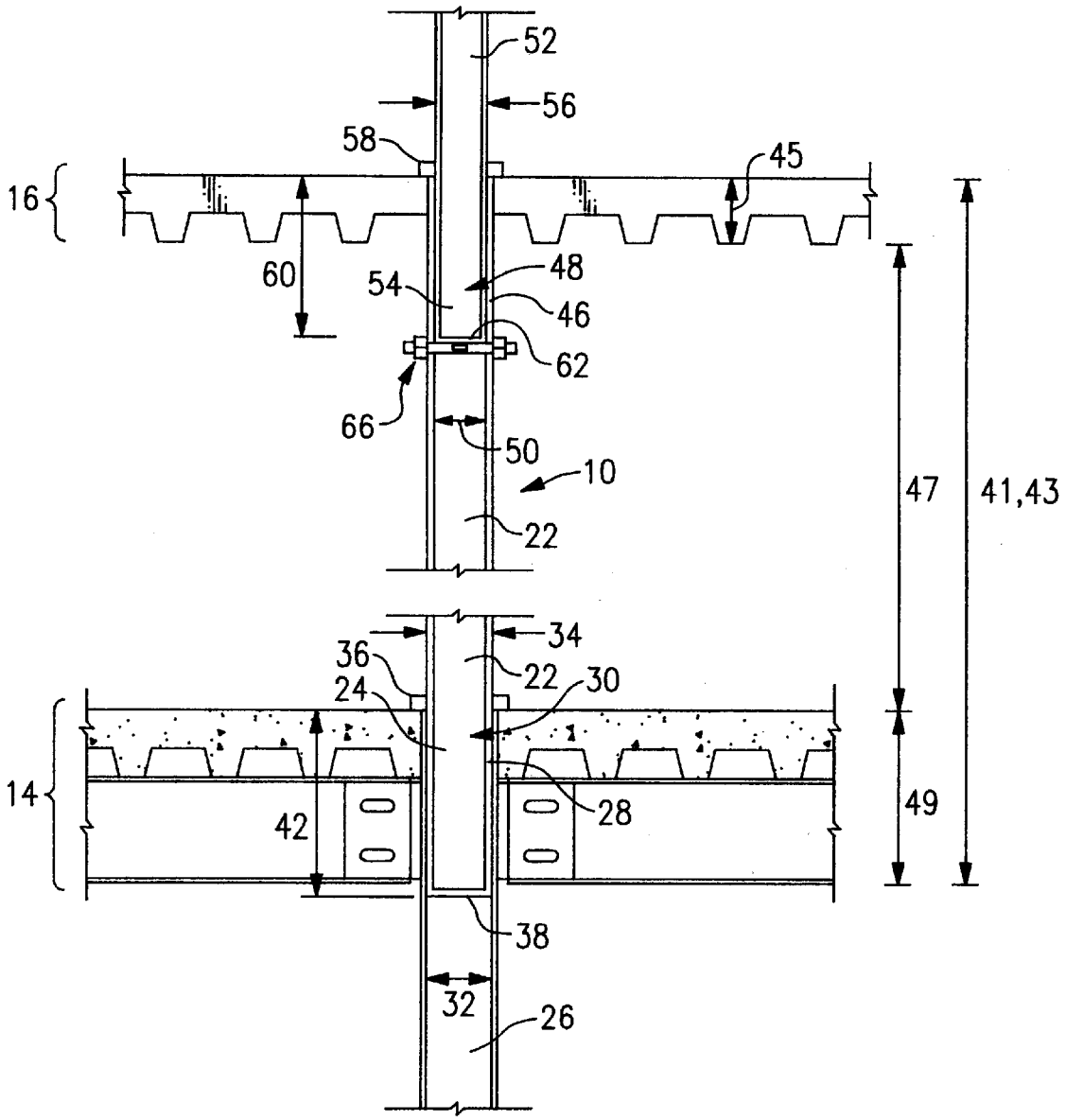
FIG. 2 is an elevation view of a first column and a portion of a second column from FIG. 1.

Referring now to FIG. 2, there is provided at least one and preferably a plurality of first column members 22 each preferably made of rectangular steel tubing with a generally uniform cross sectional shape and area along substantially all of their length. Optionally, the first columns 22 may have a circular, hexagonal, octagonal or other regular or irregular shape known to those skilled in the art and along only a portion of its length. Also, the first columns 22 may optionally be constructed of other metals, concrete, wood, or other materials known to those skilled in the art.

Each first column 22 has a lower portion 24 that may be secured to the first floor 14 in any of a number of ways. Preferably, each first column 22 is secured to the first floor 14 by at least one base column 26 that is attached to the first floor 14 by bolting, welding, embedding in concrete, brackets, plates, or by other construction methods known to those skilled in the art. Optionally, the first columns 22 may be attached directly to the first floor 14 by bolting, welding, embedding in concrete, brackets, plates, or by other construction methods known to those skilled in the art.

Each base column 26 of the preferred embodiment has a construction similar to the first columns 22, that is, they are preferably made of a rectangular steel tubing with a generally uniform cross sectional shape and area along substantially all of their length but may optionally be provided in other arrangements. Each base column 26 has an upper portion 28 with a bore 30 defined therein with an inner dimension 32. Each first column lower portion 28 has an outer dimension 34 that is substantially the same or less than the inner dimension 32 of the base column upper portion bore 30. Each first column lower portion 24 may thus be slidingly received by any base column upper portion 28 in an overlapping, telescopic arrangement. Accordingly, each first column 22 preferably will have a height 41 corresponding to a first story height 43 which includes a second floor height 45, a height 47 between the second floor 16 and the first floor 14, and at least a portion of a first floor height 49.

Figure 3:
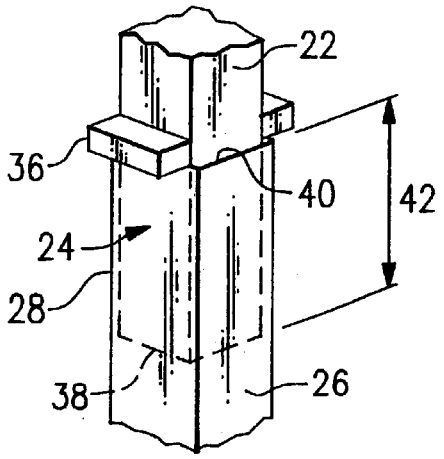
FIG. 3 is a perspective detail view of a base retainer from FIG. 2.

Referring further to FIG. 3, at least one and preferably two base retainers 36 are preferably provided attached to the first column lower portion 24 by bolting, welding or other techniques known to those skilled in the art. The retainers 36 may be attached to the first column lower portion 24 during fabrication of the first column 22 tn the factory or in the field.

The retainers 36 engage a top 40 of the base column upper portion 28 and support the load thereon of the above columns as described hereinbelow. Each base retainer 36 is preferably provided by a rectangular steel bar. Optionally, each retainer 36 may be provided by a bracket, plate, or like retainer and may be made of other metals, concrete, wood or other materials known to those skilled in the art, as selected to support the load of the above columns. The height of the retainers 36 may be further selected so that when installed they provide a screed point for applying a concrete layer to the first floor 14.

The retainers 36 are preferably attached to the first column 22 at a predetermined distance 42 from a bottom 38 of the first column 22, the distance 42 selected to provide an overlap between the first column lower portion 24 and the base column upper portion 28 sufficient to prevent lateral forces on the columns 22 and 26 from bending them, particularly during erection of the columns 22 and 26. In the typical three story building, for example, the distance 42 may be approximately the height 49 of the typical building first floor 14. optionally, the distance 42 may be greater than the floor height 49 for a building with thinner floors or a greater number of stories or lesser than the floor height 49 for a building with thicker floors or a lesser number of stories. It has been determined that an overlap distance 42 of about 10% of the column height 41 generally provides good stability and strength without adding undue weight or length, though larger or smaller overlap distances 42 may be suitably employed.

Referring back to FIG. 2, each first column 22 has an upper portion 46 with a construction similar to the base column upper portion 28, that is, the first column upper portion 46 has a bore 48 defined therein with an inner dimension 50. Each first column upper portion 46 may be attached to the second floor 16 by bolting, welding, brackets, plates, or by other construction methods known to those skilled in the art.

At least one and preferably a plurality of second columns 52 are provided with each having a construction similar to the first columns 22, that is, each preferably made of rectangular steel tubing with a generally uniform cross sectional shape and area along substantially all of its length, though optional arrangements may be suitably employed. Each second column 52 has a lower portion 54 with an outer dimension 56 that is substantially the same or less than the inner dimension 50 of the first column upper portion bore 48. The second column lower portion 54 may thus be slidingly received by the first column upper portion 46 in an overlapping, telescopic arrangement. Accordingly, each second column 52 preferably will have a height 61 corresponding to a second story height 63 which includes a third floor height 65, a height 67 between the third floor 18 and the second floor 16, and at least a portion of a second floor height 45. The weight of the second column 52 and the building components thereabove act to hold the column 52 in place.

Figure 4:
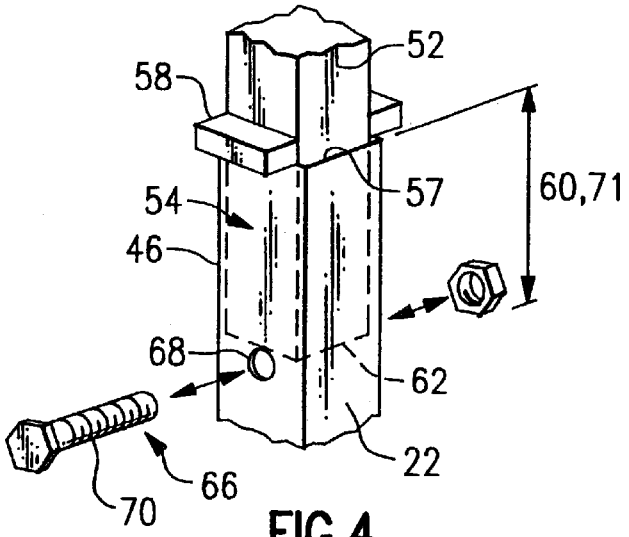
FIG. 4 is a perspective detail view of an upper and lower retainer from FIG. 2.

Referring further to FIG. 4, at least one and preferably two first upper retainers 58 are preferably provided having a construction similar to the base retainer 36, that is, rectangular steel bars, though optional arrangements may be suitably employed. Each retainer 58 is preferably attached to the second column lower portion 54 by bolting, welding or other techniques known to those skilled in the art. The retainers 58 engage a top 57 of the first column upper portion 46 and support the load thereon of the above columns.

Similarly to the base retainers 36, the first upper retainers 58 are preferably attached to the second column 52 at a predetermined distance 60 from a bottom 62 of the second column 52, the distance 60 selected to provide a distance of overlap between the second column lower portion 54 and the first column upper portion 46 sufficient to prevent lateral forces on the columns 22 and 52 from bending them. In the typical three story building, for example, the distance 60 may be approximately the height 45 of the typical building second floor 16 (See FIGS. 1 and 2). Optionally, the distance 60 may be greater than the floor height 45 for a building with thinner floors or a greater number of stories or less than the floor height 45 for a building with thicker floors or a lesser number of stories.

There may further be provided at least one first lower retainer 66 comprising at least one aperture 68 defined through the first column upper portion 46 and an elongate member 70 that may be received by the aperture 68 to extend through the first column 46 see FIGS. 1 and 2. The elongate member 70 is preferably provided by a threaded steel bolt with a correspondingly threaded nut. Optionally, the elongate member 70 may be provided by a pin, dowel, rectangular bar, or other retainer member known to those skilled in the art. The elongate member 70 engages the bottom 62 of the first column upper portion 46 and supports the load thereon of the above columns. It should be noted that the second column lower portion 54 may be provided as a solid member or with a cap attached thereto for distributing the load of the elongate member 70 thereacross.

The aperture 68 of the lower retainer 66 is preferably provided in the second column 52 at a distance 71 from the top 57 of the first column 22, the distance 71 selected for similar purposes as the distance 60, that is, to provide a distance of overlap between the second column lower portion 54 and the first column upper portion 46 sufficient to prevent lateral forces on the columns 22 and 52 from bending them. It will be noted that the lower retainer 66 may be provided in addition to or as an alternative to the upper retainer 58, as desired distribute the load in a given building design.

Referring back to FIG. 1, each second column 52 has an upper portion 72 which may be attached to a building top structure 20 in the case of a two story building by bolting, welding, brackets, plates, or by other construction methods known to those skilled in the art. In the present example of a three story building 12, each upper portion 72 has a construction similar to the first column upper portion 46 for slidably receiving a lower portion 74 of at least one third column member 76. Each third column 76 preferably has a construction similar to the first and second columns 22 and 52, that is, each is preferably made of rectangular steel tubing with a generally uniform cross sectional shape and area along substantially all of its length, though optional arrangements may be suitably employed. At least one second upper retainer 78 and at least one second lower retainer 80 may be provided similarly to the first upper retainer 58 and the first lower retainer 66. Each third column 76 has an upper portion 82 which may be attached to a building top structure 20 such as the attic floor or roof by bolting, welding, brackets, plates, or by other construction methods known to those skilled in the art. Each third column lower portion 74 may thus be slidingly received by the second column upper portion 72 in an overlapping, telescopic arrangement.

In selecting the columns 22, 52 and 76 for the three story building 12 described herein as an example, the number, size, and spacing of columns 22, 52, and 76 is selected based on the desired structural requirements of the building 12 with consideration to the fact that each ascending column series has a smaller cross sectional area than the columns series immediately therebelow. For example, the first columns 22 may be provided by 4" by 4" square tubular steel, the second columns 52 by 3½" by 3½" square tubular steel, and the third columns 76 by 3" by 3" square tubular steel. Thus, for a building with more than three stories, the columns 22, 52, and 76 may have a larger cross sectional size and/or or a smaller spacing.

Figure 6:
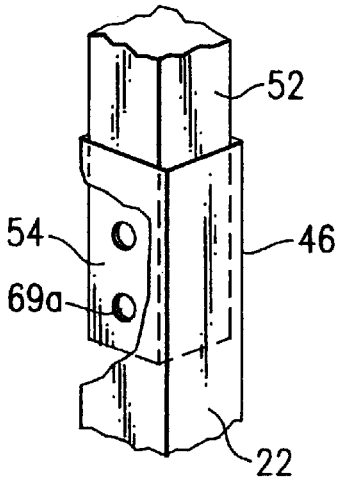
FIG. 6 is a perspective view of the lower retainer of FIG. 5 with a cutaway portion thereof.
Figure 5:
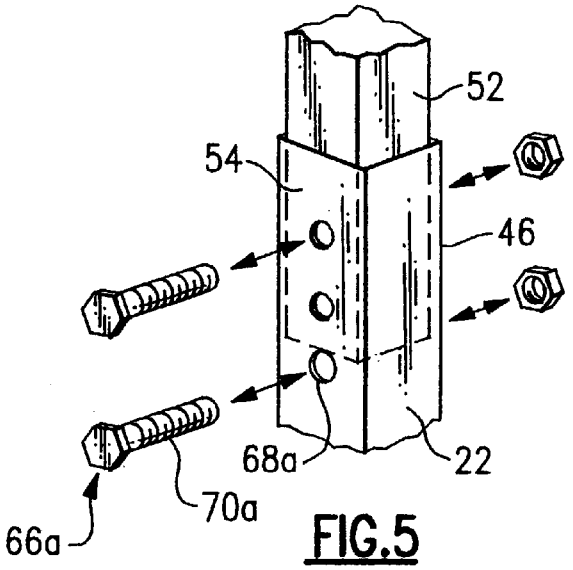
FIG. 5 is a perspective view of a second preferred embodiment of the lower retainer of the stackable support columns.

Referring now to FIGS. 5 and 6, in a second preferred embodiment of the present invention there are provided at least one alternative lower retainer 66*a* comprising a plurality of apertures 68*a* defined through the first column upper portion 46, a plurality of apertures 69*a* defined through the second column lower portion 54 capable of being aligned with the apertures 68*a*, and a plurality of elongate members 70*a* each of which may be received by the aligned apertures 68*a* and 69*a* to extend through the first column 46. The plurality of elongate members 70*a* provide added points of support for the loaded columns thereabove, fixedly secure the columns in place, and provide flexibility by permitting standardized columns that may be used in different building designs.

It will be noted that various other arrangements of the columns may be suitably employed. For example, each column may be provided in two sections with an overlapping, telescopic portion and retainers similar to those of the preferred embodiment as described hereinabove. In this arrangement, braces may be added in the interior walls of the building for added lateral support. In another example, a sleeve is fixedly attached over and onto the end of one column for receiving therein the end of another column of similar size. Also, the tubular steel columns may be filled with a material such as a foam, particle matter, concrete, a composite or the like selected for high strength and low weight.

The method of constructing a multistory building in accordance with the present invention comprises installing the plurality of first column members 22 on the first floor 14. Preferably, each first column lower portion 24 is inserted into the bore 30 of the upper portion 28 of the base column 26 which is attached to the first floor 14, and each first column 22 is retained in place and supported by the base retainers 36 attached to the base column upper portion 28. Optionally, each first column lower portion 24 may be attached directly to the first floor 14 as described hereinabove.

Once the desired number of first columns 22 have been installed, the plurality of second columns 52 are then installed by inserting the lower portion 54 of each second column 52 into the bore 48 of the upper portion 46 of one of the first columns 22 so that the second column lower portions 54 and the first column upper portions 46 overlap in a telescopic arrangement. Each second column 22 is retained in place and supported by the first upper 58 and/or lower 66 retainers.

Similarly, the plurality of third columns 76 are then associated with the second columns 52 by inserting the lower portion 74 of each third column 76 into the upper portion 72 of one of the second columns 52 so that the third column lower portions 74 and the second column upper portions 72 overlap in a telescopic arrangement. Each second column 52 is retained in place and supported by the second upper 78 and/or lower 80 retainers. The building top structure 20 is then attached to the upper portions 82 of the third columns 76. Walls and other building components are then installed to complete the building structure.

Accordingly, there are a number of advantages provided by the present invention 10. The column members 22, 52, and 76 have lengths generally corresponding to each building story height thus providing the advantage of achieving a relatively light weight and low bulk so that they can be manually lifted into position without the aid of a crane or mechanical hoist resulting in quicker and easier erection of the building structure.

The lower portion 24, 54, and 74 of each column 22, 52, and 76 may be slidingly received by the upper portion 28, 46, and 72 of the immediately below column 26, 22, 52 in an overlapping, telescopic arrangement which acts as a strengthening brace to resist and/or absorb lateral forces and prevent bending at the joints thus providing the advantage of a structurally strong joint between the column members 26, 22, 52, and 76.

The upper retainers 36, 58, and 78 and/or lower retainers 66 and 80 are attached to the columns 26, 22, 52, and 76 during the fabrication of the columns 26, 22, 52, 76 to provide the advantage of supporting the columns 26, 22, 52, 76 without the need to bolt or weld the columns 26, 22, 52, 76 together in the field resulting in an installation that is low cost, quick and easy.

The method for multistory building construction provides the advantage of lifting without the aid of mechanical lifting devices the short, lightweight columns 26, 22, 52, and 76, lowering each column 22, 52, and 76 into the immediately below column 26, 22, and 52 to form an overlapping, telescopic portion which braces against bending of the columns 26, 22, 52, 76, and retaining the columns 22, 52, and 76 in place without the need for field bolting or welding.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A stackable support column apparatus in combination with multistory building, comprising:

a) at least one first column having a lower portion and an upper portion, said lower portion detachably coupled to a first floor of said building, said upper portion detachably coupled to a second floor of said building, said first column upper portion having a top that is positioned adjacent a top of said second floor, said upper portion having a bore defined therein with an inner dimension;

at least one second column having a lower portion and an upper portion, said lower portion having an outer dimension that is substantially the same or slightly less than said first column upper portion inner dimension, said second column lower portion slidingly received by said first column upper portion, said upper portion detachably coupled to a third floor or a top structure of said building; and, at least one first retainer associated with said first or second column, said first retainer positioned adjacent said top or a bottom of said second floor, said retainer abutting and supporting said second column thereon.

2. The apparatus of claim 1, wherein said first column has a height generally corresponding to a height of a first story of said building and said second column has a height generally corresponding to a height of a second story of said building.

3. The apparatus of claim 1, wherein said first column has a generally uniform cross-section shape and area, and said second column has a generally uniform cross-section shape that is substantially the same as said first column and area that is less than said first column.

4. The apparatus of claim 3, wherein said first column upper portion inner dimension is less than an outer dimension of a lower portion of said first column, and said second column lower portion outer dimension is greater than an inner dimension of an upper portion of said second column.

5. The apparatus of claim 1, wherein said first column has a top and is detachably coupled to said second floor such that said top is generally coplanar with a top surface of said second floor.

6. The apparatus of claim 1, wherein said second column lower portion is capable of being slidingly received generally into said first column upper portion in an overlapping, telescopic arrangement.

7. The apparatus of claim 6, wherein said overlapping portion has an overlapping distance that is substantially the same or slightly greater than a thickness of said second floor.

8. The apparatus of claim 1, wherein said first retainer comprises at least one upper retainer member attached to said second column at an upper end of said lower portion thereof, said upper retainer abutted and supported by a top of said first column.

9. The apparatus of claim 7, wherein said first retainer comprises at least one upper retainer member attached to said second column at a distance from a bottom thereof, said distance being substantially the same as said overlapping distance, said upper retainer capable of being engaged and supported by a top of said first column.

10. The apparatus of claim 1, wherein said first retainer comprises at least one lower retainer having at least one aperture defined in said first column and at least one elongate member capable of extending therethrough, said elongate member capable of engaging and supporting a bottom end of said second column.

11. The apparatus of claim 7, wherein said first retainer comprises at least one lower retainer having at least one aperture defined in said first column at a distance from a top thereof and at least one elongate member extending therethrough, said distance being substantially the same as said overlapping distance, said lower retainer abutting and supporting a bottom end of said second column.

12. The apparatus of claim 1, wherein said first column lower portion has an outer dimension, and further comprising:

a) at least one base column having an upper portion detachably coupled to said first floor, said upper portion having a bore defined therein with an inner dimension that is substantially the same or greater than said first column lower portion outer dimension, said upper portion slidingly receiving said first column lower portion; and, b) at least one base retainer coupled to said first column and engaging said base column and supporting said first column thereon.

13. The apparatus of claim 1, wherein said second column upper portion has a bore defined therein with an inner dimension, and further comprising:

a) at least one third column having a lower portion and an upper portion, said upper portion being detachably coupled to a fourth floor or top of said building, said lower portion having an outer dimension that is substantially the same or less than said third column tower portion inner dimension, said lower portion slidingly received by said third column upper portion; and, b) at least one second retainer coupled to said third column and engaging said second column and supporting said third column thereon.

14. The apparatus of claim 13, wherein said third column lower portion is being slidingly received into said second column upper portion in an overlapping, telescopic arrangement.

15. The apparatus of claim 14, wherein said overlapping portion has an overlapping distance that is substantially the same or slightly greater than a thickness of said third floor.

16. A stackable support column apparatus in combination with multistory building, comprising:

a) a plurality of first columns each having a height generally corresponding to a height of a first story of said building, each having a generally uniform cross-section shape and area, each having a lower portion and an upper portion, said lower portions being detachably coupled to said first floor of said building, said upper portions detachably coupled to a second floor of said building, each of said upper portions having a bore defined therein with an inner dimension;

b) a plurality of second columns each having a height generally corresponding to a height of second story, each having a generally uniform cross-section shape that is substantially the same as said first column and area that is less than said first column, each having a lower portion and an upper portion, each of said lower portions having an outer dimension that is substantially the same or slightly less than said first column upper portion inner dimension, each second column lower portion slidingly received by any of said first column upper portions in an overlapping, telescopic arrangement defining an overlapping distance, said upper portions detachably coupled to a third floor or a top structure of said building; and, c) a plurality of first retainers each coupled to one of said first or second columns, said retainer engaging and supporting said second column thereon, at least one of said first retainers comprising at least one upper rectangular bar attached to said second column lower portion at a distance from a bottom thereof, said distance being substantially the same as said overlapping distance, said upper retainer engaged and supported by a top of said first column.

17. The apparatus of claim 16, wherein said first column upper portion inner dimension is less than an outer dimension of a lower portion of said first column, and said second column lower portion outer dimension is greater than an inner dimension of an upper portion of said second column.

18. The apparatus of claim 16, wherein said second column has a top and is detachably coupled to said third floor such that said top is generally coplanar with a top surface of said third floor.

19. The apparatus of claim 16, wherein said overlapping distance is substantially the same or slightly greater than a thickness of said second floor.

20. The apparatus of claim 16, wherein said upper retainer bar comprises a steel bar welded to said second column lower portion.

21. The apparatus of claim 16, wherein said first retainer comprises at least one lower retainer having at least one aperture defined in said first column at a distance from a top thereof and at least one elongate member extending therethrough, said distance being substantially the same as said overlapping distance said lower retainer capable of butting and supporting a bottom end of said second column.

22. The apparatus of claim 21, wherein said elongate member comprises at least one threaded bolt.

23. The apparatus of claim 16, wherein said first and second columns each comprise at least one rectangular steel tube.

24. A method for constructing a multistory building, comprising the steps of:

a) providing a first floor of said building;

b) lifting at least one first column member onto said first floor;

c) attaching a lower portion of said first column to said first floor;

d) attaching a second floor to an upper portion of said first column;

e) lifting a second column member onto said second floor;

f) sliding a lower portion of said second column down into a bore defined in said first column upper portion;

g) bracing said second column by sliding said second column lower portion into said first column upper portion a sufficient distance so that said second column lower portion and said first column upper portion overlap in a telescopic arrangement;

h) supporting said second column by at least one retainer associated with said second column that engages said first column; and, i) attaching a third floor or building top structure to an upper portion of said second column.

25. The method of claim 24, wherein said step of attaching a lower portion of said first column to said first floor comprises the steps of:

a) attaching an upper portion of a base column to said first floor;

b) sliding a lower portion of said first column down into a bore defined in said base column upper portion;

c) bracing said first column by sliding said first column loser portion into said base column upper portion a sufficient distance so that said first column lower portion and said second column upper portion overlap in a telescopic arrangement; and, d) supporting said first column by at least one retainer associated with said first column that engages said base column.

26. The method of claim 24, wherein said steps e) through i) are repeated for a third floor of said building.

27. The apparatus of claim 8, wherein s aid upper retainer member comprises a rectangular bar attached to said second column lower portion.

28. The apparatus of claim 10, wherein said lower retainer member abuts and supports a bottom of said first column.

* * * * *